US008658006B2

(12) United States Patent
Bialas et al.

(10) Patent No.: US 8,658,006 B2
(45) Date of Patent: Feb. 25, 2014

(54) SYSTEM AND METHOD FOR ELECTROPOLISING DEVICES

(75) Inventors: Michael R. Bialas, Wildomar, CA (US); David P. Strauss, Temecula, CA (US); Robert Barbier, Perris, CA (US); Duane M. DeMore, Temecula, CA (US); Alan Gene Tahran, Manteca, CA (US); Zhicheng Lin, Palo Alto, CA (US); Sophia Wong, Santa Clara, CA (US)

(73) Assignee: Abbott Cardiovascular Systems Inc., Santa Clara, CA (US)

( * ) Notice: Subject to any disclaimer, the term of this patent is extended or adjusted under 35 U.S.C. 154(b) by 588 days.

(21) Appl. No.: 12/758,485

(22) Filed: Apr. 12, 2010

(65) Prior Publication Data

US 2011/0247943 A1 Oct. 13, 2011

(51) Int. Cl.
*C25F 7/00* (2006.01)

(52) U.S. Cl.
USPC ..... 204/199; 204/212; 205/640; 205/646

(58) Field of Classification Search
USPC ..... 204/199, 212; 205/640, 686
See application file for complete search history.

(56) References Cited

U.S. PATENT DOCUMENTS

| | | | |
|---|---|---|---|
| 2,645,611 | A | 7/1953 | Axtell |
| 2,674,571 | A | 4/1954 | Prosen |
| 2,938,850 | A | 5/1960 | Nali |
| 3,556,883 | A | 1/1971 | Ohsawa |
| 3,645,857 | A | 2/1972 | Fisher et al. |
| 3,986,970 | A | 10/1976 | Shiga |
| 4,048,048 | A | 9/1977 | Bennett et al. |
| 4,290,867 | A | 9/1981 | Jumer |
| 4,330,381 | A | 5/1982 | Jumer |
| 4,367,127 | A | 1/1983 | Messing et al. |
| 4,425,204 | A | 1/1984 | McLaughlin |
| 5,158,548 | A | 10/1992 | Lau et al. |
| 5,217,586 | A | 6/1993 | Datta et al. |
| 5,344,425 | A | 9/1994 | Sawyer |
| 5,378,331 | A | 1/1995 | Kemp |
| 5,421,955 | A | 6/1995 | Lau et al. |
| 5,449,372 | A | 9/1995 | Schmaltz et al. |
| 5,514,154 | A | 5/1996 | Lau et al. |
| 5,605,611 | A | 2/1997 | Ozawa et al. |

(Continued)

FOREIGN PATENT DOCUMENTS

| | | | |
|---|---|---|---|
| JP | 56152999 | A | 11/1981 |
| JP | 09207029 | A | 8/1997 |

(Continued)

OTHER PUBLICATIONS

Standard Guide for Electrolytic Polishing of Metallographic Specimens, American Society and Materials (Designation: E 1558-93), pp. 1-12, 1993.

(Continued)

*Primary Examiner* — Nicholas A Smith
(74) *Attorney, Agent, or Firm* — Fulwider Patton LLP

(57) ABSTRACT

A system and method is described for electropolishing tubular metallic prostheses. In one aspect, the system provides a continuously changing set of points of contact between anode and prosthesis. In another aspect, the cathode is given a conical shape to correct for current concentrations that would otherwise exist and unevenly affect the amount of electropolishing over the length of the prosthesis.

2 Claims, 11 Drawing Sheets

(56) References Cited

U.S. PATENT DOCUMENTS

| | | | | |
|---|---|---|---|---|
| 5,679,470 | A | 10/1997 | Mayer | |
| 5,421,955 | B1 | 1/1998 | Lau et al. | |
| 5,750,434 | A | 5/1998 | Urushidani et al. | |
| 5,788,558 | A | 8/1998 | Klein | |
| 5,824,077 | A | 10/1998 | Mayer | |
| 5,891,191 | A | 4/1999 | Stinson | |
| 5,891,507 | A | 4/1999 | Jayaraman | |
| 5,972,180 | A | 10/1999 | Chujo | |
| 5,985,126 | A | 11/1999 | Bleck et al. | |
| 5,997,703 | A | 12/1999 | Richter et al. | |
| 6,019,784 | A | 2/2000 | Hines et al. | |
| 6,086,455 | A | 7/2000 | Frantzen | |
| 6,131,266 | A | 10/2000 | Saunders et al. | |
| 6,183,353 | B1 | 2/2001 | Frantzen | |
| 6,214,200 | B1 | 4/2001 | Altena et al. | |
| 6,315,885 | B1 | 11/2001 | Hocheng | |
| 6,334,871 | B1 | 1/2002 | Dor et al. | |
| 6,348,138 | B1 * | 2/2002 | Yoshimura et al. | 204/212 |
| 6,355,058 | B1 | 3/2002 | Pacetti et al. | |
| 6,375,826 | B1 | 4/2002 | Wang et al. | |
| 6,465,124 | B1 | 10/2002 | Medeiros et al. | |
| 6,599,415 | B1 | 7/2003 | Ku et al. | |
| 6,679,980 | B1 | 1/2004 | Andreacchi | |
| 6,736,952 | B2 | 5/2004 | Emesh et al. | |
| 6,916,409 | B1 | 7/2005 | Callol et al. | |
| 7,252,746 | B2 | 8/2007 | Schaeffer | |
| 7,357,854 | B1 | 4/2008 | Andreacchi | |
| 7,498,062 | B2 | 3/2009 | Calcaterra et al. | |
| 7,501,048 | B2 | 3/2009 | Loermans et al. | |
| 7,520,966 | B2 * | 4/2009 | Diaz et al. | 204/199 |
| 7,776,189 | B2 | 8/2010 | Shrivastava et al. | |
| 8,323,459 | B2 | 12/2012 | Andreacchi et al. | |
| 2002/0023843 | A1 | 2/2002 | Cherkes | |
| 2005/0098444 | A1 | 5/2005 | Schaeffer | |
| 2005/0263171 | A1 | 12/2005 | Wu et al. | |
| 2005/0288773 | A1 | 12/2005 | Glocker et al. | |
| 2007/0034527 | A1 | 2/2007 | Diaz et al. | |
| 2007/0034528 | A1 | 2/2007 | Diaz et al. | |
| 2007/0209947 | A1 | 9/2007 | Shrivastava et al. | |
| 2013/0008780 | A1 | 1/2013 | Andreacchi | |

FOREIGN PATENT DOCUMENTS

| | | | |
|---|---|---|---|
| WO | 2007103446 | A2 | 9/2007 |
| WO | 2007103446 | A3 | 1/2008 |
| WO | 2009126431 | A2 | 10/2009 |
| WO | 2009126431 | A3 | 2/2010 |

OTHER PUBLICATIONS

Standard Practice for Microetching Metal and Alloys, American Society and Materials (designation E 407-93),l pp. 1-18, 1993.

Standard Test Method for Macroetching Metals and Alloys, American Society and Materials (Designation: E 340-93), pp. 1-10, 1993.

Surman, Harmut et al., Automatic Electropolishing of Cobalt Chromium Dental Cast Alloys With a Fuzzy Logic Controller, Computers Chemical Engineering, vol. 22, No. 7-8, pp. 1099-1111, 1998.

ESMA, Inc., electropolishers are used to polish and deburr small . . . , http://www.esmainc.com/electropolishers.htm, pp. 1-2, Mar. 3, 2002.

* cited by examiner

SYSTEM AND METHOD FOR ELECTROPOLISING DEVICES

BACKGROUND

This application relates to finishing the surface of metallic prostheses that are configured for implantation and deployment in a body cavity. Specifically, the application is directed to electropolishing small tubular metal prostheses such as stents and other tubular implants.

Currently, electropolishing is the state of the art method for finishing the surfaces of metallic implants and other metallic medical devices. The goal of electropolishing a metallic implant is to achieve a smooth, corrosion-resistant, biocompatible surface. From a manufacturing standpoint, the difficulty lies in achieving this pristine surface consistently throughout every surface of the device, and in maintaining that consistency from one device to the next.

The process of electropolishing is achieved by applying a voltage, or potential difference, between a device to be polished (such as a stent) acting as an anode, and a cathode while both the anode and the cathode are submerged in a conductive electrolyte bath. This arrangement permits current to flow from the stent as anode, through the electrolyte, to the cathode. When the parameters are adjusted properly, this process removes metal ions from the surface of the stent in such a manner as to smooth the surface to a mirror finish.

Although there are many critical parameters that determine the effectiveness of an electropolishing process, one especially important factor is the type of fixing structure (sometimes referred to as "fixture") used to mount the stent on an anode to provide current (or potential difference) from the power supply to the stent and thence into the electrolyte solution. Typically, a tubular cylindrical stent is stretched over a cylindrical anode to provide enough contact to ensure a robust electrical connection between stent and anode, by which the stent itself can act as the anode during electrolysis. However, this method does not consistently electropolish the entire stent, because regions of the stent closer to the point of electrical contact with the anode will exhibit higher current density, and will be preferentially polished. This preferential polishing effect necessitates a multi-step polishing process that requires the stent and anode to be removed from the electrolyte, after which the stent is removed from the anode and then manually rotated or otherwise repositioned relative to the anode before being reinserted into the electrolyte so that polishing can continue. In general, the more electropolishing steps of this kind that are taken, the more consistent the process and the more even the resulting polish imparted to the stent. Depending on the size and design of the stent, this could require anywhere from five to ten steps or even more in some cases.

Thus there is a need in the art for a system and method to overcome the above described shortcomings in the art, by which the disadvantageous effects of preferential electropolishing may be reduced. The present invention addresses these and other needs.

There is yet another problem encountered in the art of electropolishing small metallic implants or stents, which arises under the following circumstances: In the known art, a stent may be suspended or supported in electrolytic solution for polishing while being connected to an electrically charged anode. Frequently, in this process, a cathode is positioned to surround the stent acting as anode as is shown in FIG. 5*a*. In this figure, a cylindrical shaped mesh 400 acting as cathode is positioned to surround the stent 444. The stent 444 is positioned on a holder 402 that includes an elongate cylindrical portion 403 (or, blade portion) which is given a positive charge via potential difference means 410. The blade portion attaches to a connector portion 405 that is the closest point on the holder 402 that connects to the power source or potential difference means. This arrangement provides an electric current into the electrolytic solution 404 that flows between stent 444 and cathode 400. For example, a platinum-iridium woven wire mesh may be used, that is rolled into a cylinder, and is placed in the electrolyte solution to surround the stent and function as a cathode 400. In the prior art, the diameter of the cylindrical cathode 400 is constant. In use of this prior art method, an electric current is passed through the stent 444, as anode, for a short duration. Thereafter the stent is removed from the electrolyte and manually rotated about its own axis, by for example 60 degrees before being reinstalled on the blade portion 403, so that the area that previously touched the blade portion will be exposed to the solution to ensure even polishing. The rotation step is typically performed three times. Thereafter the entire stent 444 is removed from the blade portion 403 and turned end-over-end before being placed back onto the blade portion for three more polishes, alignments and rotations.

This end over end rotation is used because the top of the stent becomes polished to a greater extent than the bottom of the stent while suspended in the polishing electrolyte mixture. It is believed that this effect is attributable to the fact that the top of the stent is closer to the point at which the holder 402 attaches to the connector portion 405—which is in direct contact with the electric power supply. Thus, the current flow density into the electrolyte is greatest adjacent the point of connection of the stent to the power supply 410, and becomes attenuated toward the bottom portion of the stent where it is furthest from the point of contact with the power supply 410. The attenuated current flow density leads to a lower rate of polishing, and a resulting uneven final result.

Thus, there is a further need in the art for a system and method to overcome the above described shortcomings in the art. The present invention also addresses these and other needs.

SUMMARY OF THE INVENTION

The present invention describes several systems and methods to achieve a consistently polished stent surface by the process of electropolishing.

In general terms, a first solution is provided by continuously rotating the stent and anode relative to one another throughout the electropolishing process. Such electropolishing through continuously changing points of contact between stent and anode creates a more uniform surface, decreases the time needed to complete the process, and reduces the process variability experienced in the prior art that is introduced by manually moving the stent in between electropolishing cycles. Additionally, by continuously rotating the point of contact between anode and stent, the result is to reduce the need for manual interaction with the stent/anode/electrolyte system, and this reduces operator interaction with the system thereby mitigating the potential for injury or exposure to injury by the corrosive electrolyte.

A second solution may be used in circumstances where the cathode deployed in the electrolyte solution is shaped cylindrically, to surround the stent acting as anode. In this second solution there is no continuously rotating point of contact between anode and stent. However, the cathode is given an effectively conical shape, under two different embodiments, that improve the uniform finish of the electropolished product. Details of these solutions are provided below.

A first embodiment of a system for electropolishing a tubular metal prosthesis positioned in an electrolyte bath is described. The system includes a spirally shaped track that has an axis of symmetry. The track is positionable above the electrolyte bath with the axis of symmetry extending vertically. The track comprises a first and a second spiral wire, each spiral wire being positioned in relation to the other such that the first spiral wire has a larger radius than the second spiral wire, and both spiral wires are spirally in phase with each other. A slide element is also included. It is made of conductive material and is configured to rest on the first and second spiral wires and to slide or roll down the track between the wires under the effect of gravity. A hanging wire is also included. The hanging wire is connected to the slide element and is made of conductive material. It has an upper portion and a lower portion, the upper portion extending vertically downwards to pass between the first and second spiral wires, the lower portion extending vertically downwardly beyond the spiral wires, whereby when the slide element slides or rolls down the track under the effect of gravity, the lower portion rotates to describe (or, trace out) a cylindrical form. The system is configured to allow an electric current to flow through at least one of the spiral wires, thence through the slide element, and thence through the hanging wire, while the slide element slides or rolls down the track under the effect of gravity.

In a preferred aspect, the lower portion of the hanging wire passes through a bearing located on the axis. The bearing is configured to hold at least a section of the lower portion coaxial with the track axis. In a further aspect, the cylindrical form described by the lower portion of the hanging wire is sized to fit inside the tubular prosthesis.

In a second embodiment of the invention, a system for electropolishing a tubular metal prosthesis positioned in an electrolyte bath is described. The system comprises a first and a second cylinder positioned parallel to each other and spaced apart sufficiently to support the prosthesis when the prosthesis extends parallel to the first and second cylinders. A wire element is configured to extend through the tubular prosthesis and to bias towards the two cylinders, such that the wire element is capable of contacting an inner wall of the tubular prosthesis to urge the prosthesis into contact with the first and second cylinders. Under this arrangement, frictional engagement between the cylinders and the prosthesis causes the prosthesis and the cylinders to rotate in unison if any one of the prosthesis and cylinders rotates, whereby, when the prosthesis rotates, the wire element remains in biased contact with the inner wall through a continuously changing set of points of contact. As a result, the wire element is capable of conducting a charge and passing the charge into the prosthesis through the continuously changing set of points of contact.

In a preferred aspect of this embodiment, a motor is provided that is configured to rotate a first magnet located outside the electrolyte bath. Furthermore, the first cylinder includes a second magnetic flywheel rotationally mounted on the first cylinder. Under this arrangement, rotation of the first magnet outside the bath causes rotation of the second magnetic flywheel inside the bath, thereby causing the first cylinder to rotate.

In another aspect of this embodiment of the invention, the wire element is configured to rotate, and thereby, through frictional engagement with the prosthesis, causing the prosthesis to rotate.

In a further embodiment of the invention, a system for electropolishing a tubular metal prosthesis positioned in an electrolyte bath is described. The system includes a cylindrical tubular bath having an axis and an internal wall. The bath is sized to receive within its profile, for polishing, a tubular prosthesis extending parallel with the axis. The bath being capable of conducting an electric charge. The system also includes a holding wire configured to extend parallel with the axis while positioned adjacent the internal wall of the bath. The holding wire is configured to pass through the bore of the tubular prosthesis so as to support the prosthesis and, simultaneously, to bias the prosthesis onto the internal wall. A rotating arm is provided, configured to rotate about a point on the axis. The arm is configured to rotate the holding wire in a complete circle so that the wire traces out the form of a cylinder adjacent the internal wall, whereby a prosthesis supported by the wire is in constant biased contact with the internal wall. Under this arrangement, the holding wire is capable of conducting a charge and passing the charge into the prosthesis through a continuously changing set of points of contact between the holding wire and the prosthesis.

Yet a further embodiment of a system for electropolishing a cylindrical metal prosthesis positioned in an electrolyte bath is described. The system includes a cylindrical tubular bath having an axis and an internal wall. The tubular bath is sized to receive within its profile, for polishing, a tubular prosthesis extending parallel with the axis. The bath is capable of conducting an electric charge. A plurality of conductive panels are mounted on the internal wall. Each panel is positioned around the internal wall of the bath to be located adjacent to and separate from a neighboring panel. A distributor is provided and is operated by a microprocessor, the distributor being configured to distribute electric charge between the panels so that one panel is always positively charged, and the remaining panels are always negatively charged. Further, the under the operation of the distributor, the identity of the positively charged panel moves sequentially around the circumference from one panel to an adjacent panel at a first angular velocity. A holding wire is provided, and is configured to extend parallel with the axis while positioned adjacent the internal wall of the tube. The holding wire is configured to support the prosthesis and, simultaneously, to bias the prosthesis onto the panels mounted on the internal wall. A rotating arm is provided, and is configured to rotate about a point on the axis at a second angular velocity. The second angular velocity is the same as the first angular velocity. The arm is further configured to rotate the holding wire in a complete circle so that the wire traces out the form of a cylinder adjacent the internal wall, whereby a prosthesis supported by the wire is in constant biased contact with the internal wall, and is always in contact with at least one panel. Under this arrangement, the distributor is configured to direct a positive charge to whichever panel is in contact with the prosthesis, so that the prosthesis is in continuous contact with a positively charged panel that passes the charge into the prosthesis through a continuously changing set of points of contact with the prosthesis.

Yet a further system for electropolishing a tubular metal prosthesis positioned in an electrolyte bath is described. The prosthesis has first and second opposing ends. The system includes a holder element configured to support the cylindrical prosthesis from the first end thereby allowing the second end to extend away from the holder element, the holder element being configured to impart an anodic charge to the prosthesis. A surrounding element made of wire mesh and configured to spatially surround the prosthesis without contacting the prosthesis is provided. A first end of the surrounding element is positioned adjacent the holder element and a second end of the surrounding element is positioned remote from the holder element, the surrounding element configured to be cathodically charged. The surrounding element has a frusto conical shape with a first radius adjacent the first end of the prosthesis and a second radius adjacent the second end of the prosthesis, the first radius being larger than the second radius. In a preferred aspect, the first radius and the second radius are sized in relation to each other to impart a subtended angle to the frusto conical shape in the range of 30 degrees to 40 degrees.

A further system for electropolishing a tubular metal prosthesis positioned in an electrolyte bath is described, in which the prosthesis has first and second opposing ends. The system includes a holder element configured to support the tubular prosthesis from the first end thereby allowing the second end to extend away from the holder element. The holder element is configured to impart an anodic charge to the prosthesis. A surrounding element is provided, and is configured to spatially surround the prosthesis without contacting the prosthesis, a first end of the surrounding element being positioned adjacent the holder element and a second end of the surrounding element being positioned remote from the holder element. The surrounding element being configured to be cathodically charged. In a preferred aspect of this embodiment, the surrounding element is formed from a plurality of cylinders of differing radius, including one cylinder with a largest radius and one cylinder with a smallest radius, the cylinders being stacked one inside the other, wherein the cylinder with the largest radius is positioned adjacent the holder element and the cylinder with the smallest radius is positioned remote from the holder element. The cylinders are connected to each other by conductive elements so that the cathodic charge is spread into the surrounding element. In a preferred aspect, the conductive elements are metallic pins, and the cylinders are formed from wire mesh.

These and other advantages of the invention are described below in the detailed description of the preferred embodiments, with reference to the drawings.

DETAILED DESCRIPTION OF THE PREFERRED EMBODIMENTS

With reference to the figures, the present invention specification discloses various embodiments of systems and methods for electropolishing metal prostheses having features of the present invention.

Figure 1A:
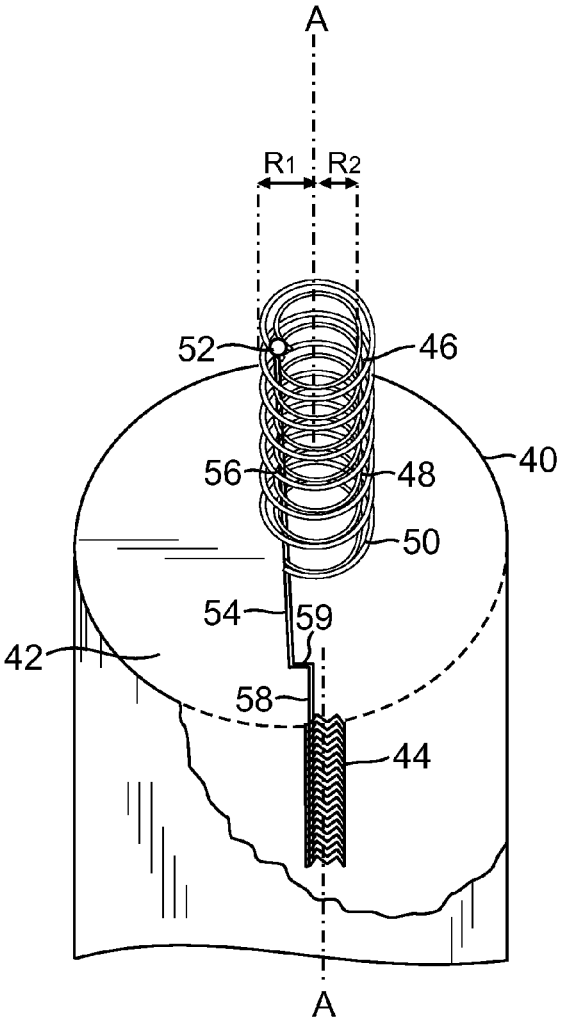
FIG. 1*a* is a perspective schematic view of a first embodiment showing features of the present invention of a system for electropolishing a stent in electrolyte solution.
Figure 1C:
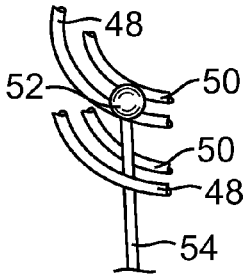
FIG. 1*c* is a detail perspective view of an aspect of FIG. 1*a*.
Figure 1B:
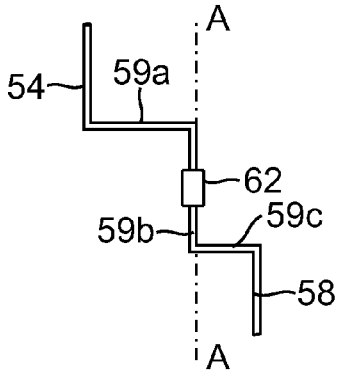
FIG. 1*b* is a detail perspective view of an aspect of FIG. 1*a*.

In a first embodiment of the invention, and with reference to FIGS. 1*a*, 1*b*, and 1*c* a system and method is described for providing an anode that eliminates the static connection between anode and stent known in the art. In this embodiment the anode is in continuous contact with, and in continuous motion in relation to, a stent undergoing electropolishing while submerged in an electrolyte solution. Such continuous motion provides a continuously changing point, or set of points, of contact between the anode and the stent. Moreover, in this embodiment, the use of a motor is avoided, thus avoiding the complications that may arise when a motor is used in close proximity with the corrosive effects of electrolyte solution.

The system and method of this embodiment commences with a receptacle 40 having known characteristics containing an electrolyte solution 42 having known characteristics. A cathode (not shown) having known characteristics is inserted into the solution 42 to provide a path for electric current in the solution. A cylindrical stent 44 to be polished is supported by a support means (not shown) within the electrolyte solution, so that the stent assumes a position with longitudinal axis extending vertically upwardly. The cathode may be cylindrically shaped and configured to surround the stent.

Directly above the stent 44 a spirally shaped track 46 is positioned and held immovable by a holding means (not shown). In a preferred embodiment, the spirally shaped track 46 comprises two wire elements spirally wound around the same central axis A-A (FIG. 1*a*). A first spiral wire 48 is shaped to have a first constant spiral radius $R_1$ that is slightly larger than a second constant spiral radius $R_2$ of a second spiral wire element 50. Yet, as seen in FIG. 1*a*, the first and second spiral wires are substantially in phase as they spiral round the central axis A-A so that for each point on the first spiral wire 48, the second element 50 occupies a corresponding point in space that has the same vertical elevation as the point on the first element, lies on the same radial line as the point on the first element, but is closer to the central axis A-A. The shape thus described has the functional capability of allowing a metal ball 52 positioned between the first and second spiral wires to move spirally downwardly under the action of gravity while remaining between the two wire elements 48, 50.

In order to harness this motion of the ball 52, a hanging wire element 54 extends downwardly from the ball, and passes between the wire elements 48 and 50, as best seen in FIG. 1*c* which is a detail view of FIG. 1*a*. The hanging wire element may include an upper linear portion 56 and a lower linear portion 58, separated by a kink 59 or other curved deformation, that has the effect of repositioning the axis of the linear wire 54 from extending between the wire elements 48, 50 (at the upper portion of the wire 54) to extending adjacent to and in contact with an internal surface of the stent 44 (at the lower portion of the wire 56). In a first embodiment, exemplified in FIG. 1*a*, the kink 59 may cause the upper portion 56 and the lower portion 58 to be positioned on the same side of the axis A-A. However, in a second embodiment, exemplified in FIG. 1*b*, the kink may cause the upper portion 56 and the lower portion 58 to be positioned on opposite sides of the axis A-A. To achieve the latter result, the kink may comprise three portions 59*a*, 59*b*, and 59*c* such that portion 59*a* extends perpendicular to the upper portion 56, portion 59*b* extends downwardly, coincident with axis A-A. And portion 59*c* extends perpendicular to lower portion 58. Moreover, a vertical cylindrical alignment bearing 62 may be positioned to hold vertical portion 59*b*, so that portion 59*b* may slide downwardly through the bearing as the ball element 52 slides or rolls down the spiral track 46.

In use, the configuration described may be used in the following way to electropolish the stent 44 according to the method of the present invention. A cathode (not shown) is positioned in the electrolyte solution, preferably cylindrically shaped to surround the stent. An electric current is passed from the positive terminal of a source of potential difference (not shown) via a connection (not shown) into at least one of the two spirally wound wires 48, 50. This current then passes into the metal ball 52 with which the spirally wound wire is in contact, and from there into the hanging wire element 54 that extends downwardly from the ball. The wire element 54, being in continuous contact at its lower end with the internal surface of the stent 44, causes the stent to have positively charged anodic properties in the electrolytic solution. Importantly, the ball slides or rolls down the track formed between the two spirally wound wires 48, 50 under the effects of gravity, and at the same time causes the vertically extending wire element 54 to rotate so that the lower portion 58 remains in continuous but changing contact with the interior surface of the stent 44, over the length of the stent. Because there is no fixed point of contact between the wire element 58 and the stent 44 during polishing, but rather a continuously changing set of points of contact, the resulting action causes the stent to become uniformly electropolished within the electrolytic solution. Thus, the need for manual intervention to reposition the stent against an anode during electropolishing is eliminated with advantageous effect.

Further advantageously, the described embodiment does not utilize a motor, so that any problems occasioned by operating a motor above a corrosive electrolyte bath in a potentially corrosive atmosphere are not encountered. The structure of the present invention may be wiped down or washed after use and then dried, to preserve it from the corrosive action that may be caused by the atmospheric condition during use.

Figure 2A:
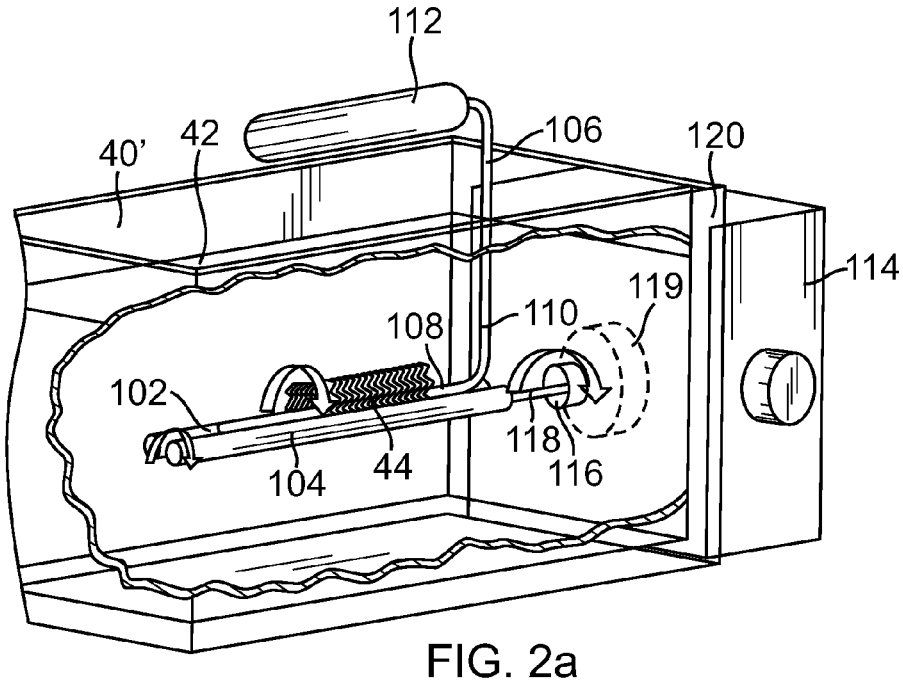
FIG. 2*a* is a perspective schematic view of a second embodiment showing features of the present invention of a system for electropolishing a stent in electrolyte solution.
Figure 2B:
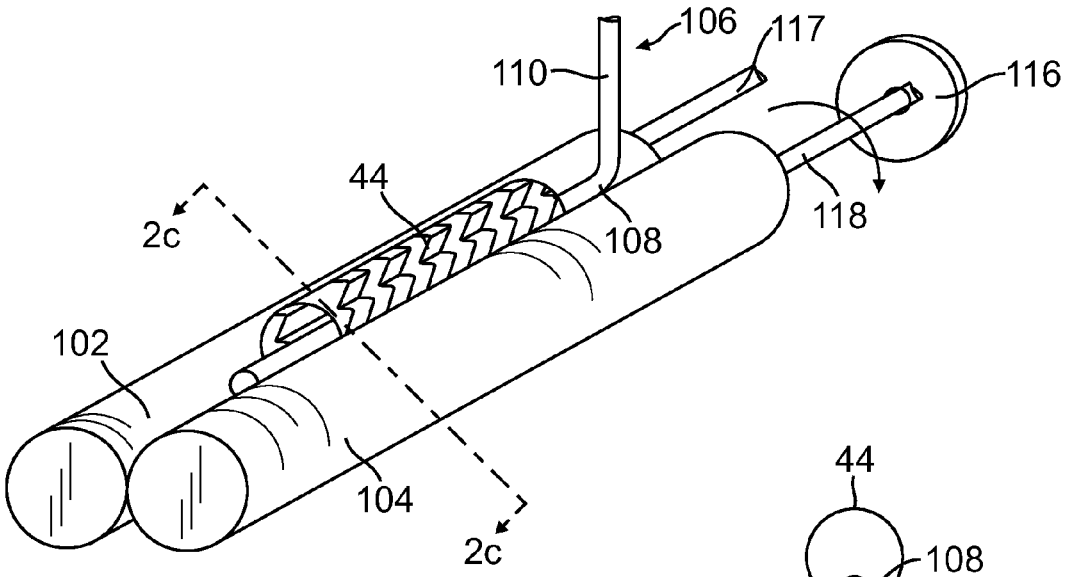
FIG. 2*b* is an expanded view of an aspect of FIG. 2*a*.
Figure 2C:
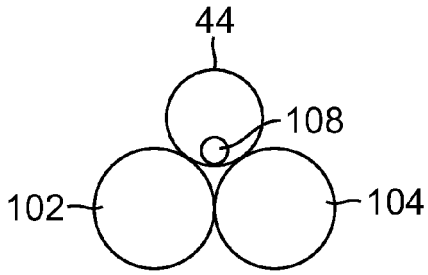
FIG. 2*c* is a sectional view taken substantially along the lines 2*c*-2*c* in FIG. 2*b*.

In another preferred embodiment of the invention, a similar result to the foregoing is achieved using a different structure, as exemplified in FIGS. 2*a*-2*c*. This alternative embodiment also starts with a receptacle 40' having known characteristics containing an electrolyte solution 42 having known characteristics. Further, a cathode (not shown) having known characteristics is inserted into the solution 42. A cylindrical stent 44 to be polished is supported within the electrolyte solution. However, in this embodiment, the structure used to achieve a constantly changing point of anodic contact with the stent initially comprises two cylindrical elements 102, 104 placed parallel side by side, and sufficiently close together so that the stent 44 may be positioned in contact with both cylindrical elements simultaneously, and may be supported by them. Preferably, the surface of each cylindrical element is knurled or roughened, so that when they rotate they cause the stent in contact with them to rotate also.

A further component of this embodiment is an elongate cylindrical anode element 106 positioned to pass through the bore of the tubular stent 44. Preferably, the anode element includes a handle portion for manipulating the stent. The handle portion may assume a number of alternative configurations. In a preferred configuration, as shown in FIG. 2*a* the anode element 106 includes a first horizontal portion 108 configured to pass through the bore of the tubular stent. A second vertical portion 110 extends perpendicular to the horizontal portion, and a third horizontal portion 112 extends perpendicular to the vertical portion 110. The third portion may include an insulated handle for manipulating the anode, and thereby manipulating the stent 44. A support means (not shown) may be provided to support the handle (or the vertical portion) of the anode so that the first horizontal portion 108 of the anode is biased into continuous contact with an internal wall of the stent 44, as exemplified in FIGS. 2*a*-2*c*.

In a further aspect of this embodiment of the invention, the two cylindrical elements are configured to be rotated in unison. Preferably, such rotation in unison may be achieved by a motor 114 that is magnetically coupled to the cylindrical elements 102, 104 without being mechanically coupled. Such coupling allows the motor to be positioned entirely outside the receptacle 40 and therefore outside the effects of the electrolyte solution 42, with the beneficial result that the motor and its moving parts are not subject to the typical corrosive effects of the electrolyte solution. This magnetic coupling may be achieved by a system wherein a metal (or magnetic) flywheel 116 is attached to an axle 118 extending from one of the cylindrical elements. It will be understood that the flywheel 116 is positioned inside a wall 120 of the receptacle 40. The motor 114 positioned external to the receptacle rotates a drive magnet 119, from which a magnetic field extends through the wall 120 of the receptacle to envelope the metal or magnetic flywheel 116. When the motor rotates the drive magnet 119, the resulting rotating magnetic field influences the flywheel 116 and causes it to rotate also. Furthermore, a set of gears (not shown) may be positioned between the axles 118, 117 of the first cylindrical element and the second cylindrical element to ensure that rotation of the two cylindrical elements is in unison and also in the same direction. In this way, an advantageous result is achieved in that a motor positioned entirely outside the corrosive influence of the electrolytic solution 42 may be activated to rotate at least one, or both, of the two cylindrical elements 102, 104 positioned inside the electrolytic solution.

It will be appreciated that when the two cylindrical elements 102, 104 with their roughened surfaces rotate in unison, the stent 44 that is positioned to be supported by, and in contact with, both cylindrical elements will be urged to rotate also through frictional engagement. It will be further appreciated that when the stent 44 rotates, the points of contact between the stent 44 and the first horizontal portion 108 of the anode 106 will continuously change.

Thus in use, the present embodiment of the invention may achieve a similar result to that of the first embodiment. An anode is configured to rotate relative to the stent (or, equivalently, the stent rotating relative to the anode), thereby providing a continuously changing set of points of contact between the anode and the stent, with the beneficial result that no single point on the stent can become the focus for electrolytic action. Rather, contact between the stent and the anode is formed by a series of rapidly changing points on the stent, and the electrolytic action is distributed to avoid any single point becoming a focus. As in the previous embodiment, this has the beneficial result of producing an evenly polished metallic prosthesis without the need to remove the stent from, and reposition it against, the anode during the polishing process.

Figure 3:
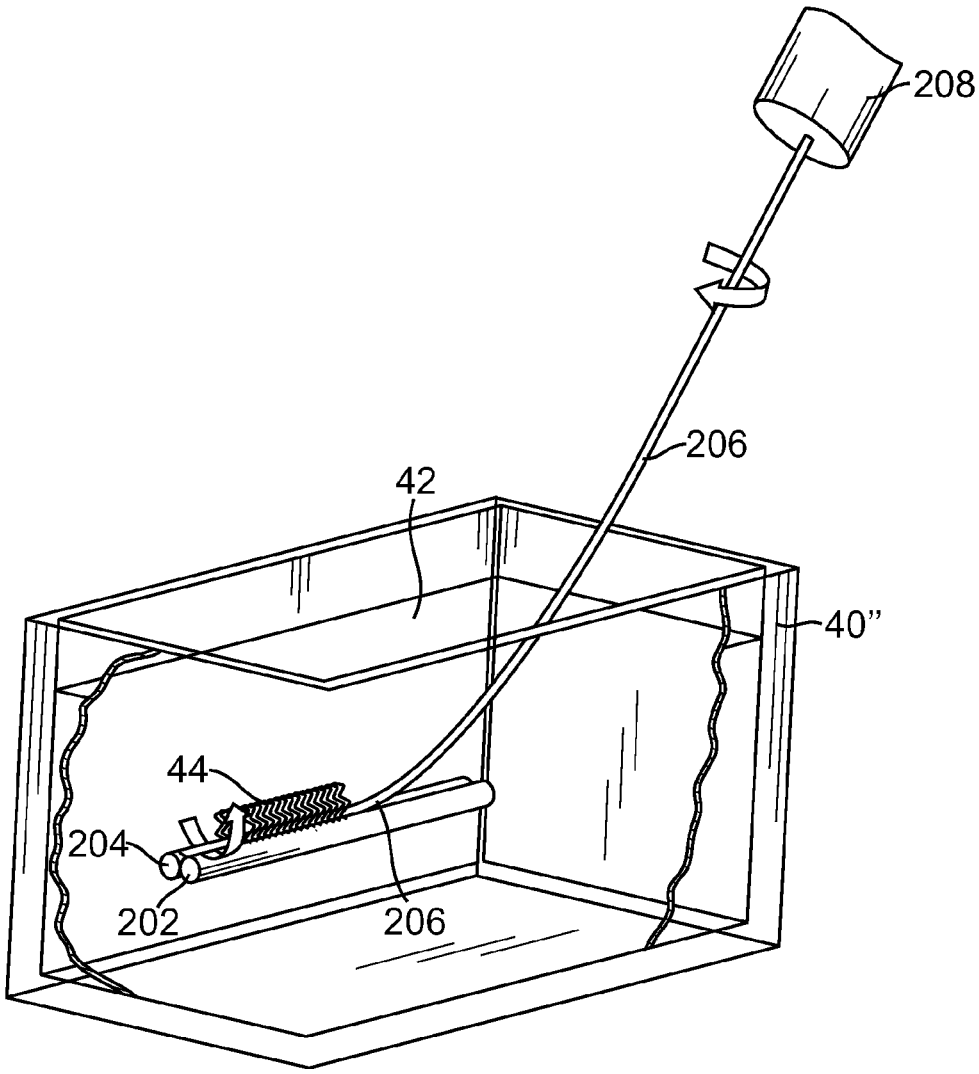
FIG. 3 is a perspective schematic view of a third embodiment showing features of the present invention of a system for electropolishing a stent in electrolyte solution.

In a third embodiment of the invention exemplified in FIG. 3, the same result may be achieved as in the previous two embodiments, although again using different structure. In this embodiment, as in the previous embodiment, two cylindrical elements 202, 204 are used to support the tubular stent 44 in a container 40" holding electrolyte solution 42. The cylindrical elements may be supported by support means (not shown) similar to the previous embodiment. A cathode (not shown) is inserted in the electrolyte solution. An anodic wire 206 is inserted through the bore of the tubular stent. However, in this embodiment, the cylindrical elements 202, 204 are not coupled to any motor (magnetically or otherwise) for providing a rotational driving force.

Rather, in this embodiment, the anode wire 206 itself, positioned to extend along the inside bore of the tubular stent, may be driven rotationally in order to cause the stent to rotate while supported by the two cylinders 202, 204 which will in turn, through frictional engagement with the stent, be caused to rotate also. However, in this embodiment the anode 206 is shaped to bend continuously upwardly out of the electrolyte solution 42 to an external terminal end that is rotationally driven by a motor 208. Preferably, the anode 206 is sufficiently long that it allows the motor 208 to be positioned a safe distance away from the electrolyte solution 42 with its corrosive properties. The bending of the anode 206 causes the portion of the anode in contact with the stent 44 to bias against the stent and to force the stent into contact with the cylindrical elements 202, 204. Thus, when the anode 206 is rotated it causes the stent to rotate under the action of frictional engagement. To enhance this effect, the anode may be knurled or roughened in the vicinity of the stent. The rotation of the stent is facilitated in that its rotation causes the cylindrical elements 202, 204 to also rotate through frictional contact with the stent. Again, to enhance this effect, the surfaces of the cylindrical elements may be knurled or roughened. This free rotation by the anode and the cylindrical elements facilitates a constantly changing set of points of contact between the stent 44 and the anode 206.

Thus in use, this embodiment of the invention produces the same result as the previous two embodiments. The set of points of contact between the anode and the stent are continuously changing, depriving the system of stationary points of contact between stent 44 and anode 206 that would disadvantageously affect the electrolysis of the stent by focusing the electrolyzing current.

In a fourth embodiment, similar beneficial results may be achieved as in the first three embodiments, yet using a different approach to solving the problem of uneven stent polishing.

The first system and method of this embodiment is described with reference to FIG. 4*a*, and utilizes an interior surface of a single cylindrical tube 300 containing electrolyte solution 301. The tube 300 is cathodically charged. A cylindrical supporting anodic wire 302 is provided, and is configured to extend inside the tube, parallel with the axis B-B of the tube and adjacent the inner surface 304 of the tube. A cylindrical stent 44 is positioned to fit over the wire 302. The wire 302 is provided with a supporting hooked end 306 that extends toward the center axis B-B of the tube, and away from the inner surface 304 of the tube, but that supports the stent from slipping off the anodic wire 302. The anodic wire is supported from above by a holding means 308 having an arm 310. The holding means and arm are configured to rotate under motor power about an axis that is coaxial with the axis B-B of the tube 300, as seen in FIG. 4*a*.

Thus, in use, when the arm 310 of the holding means rotates, the supporting anodic wire 302 also rotates and travels adjacent to the inner surface 304 of the tube 300, and biases the stent 44 to be in continuous contact with the cathodically charged surface 304. In this way, a similar objective to those of the earlier embodiments may be achieved, in which the point of contact, or set of points of contact between anode and stent in an electrolytic bath is continuously changed, thereby producing evenly polished metallic prosthesis without the need to manually remove the stent from, and reposition it against, the anode.

Figure 4A:
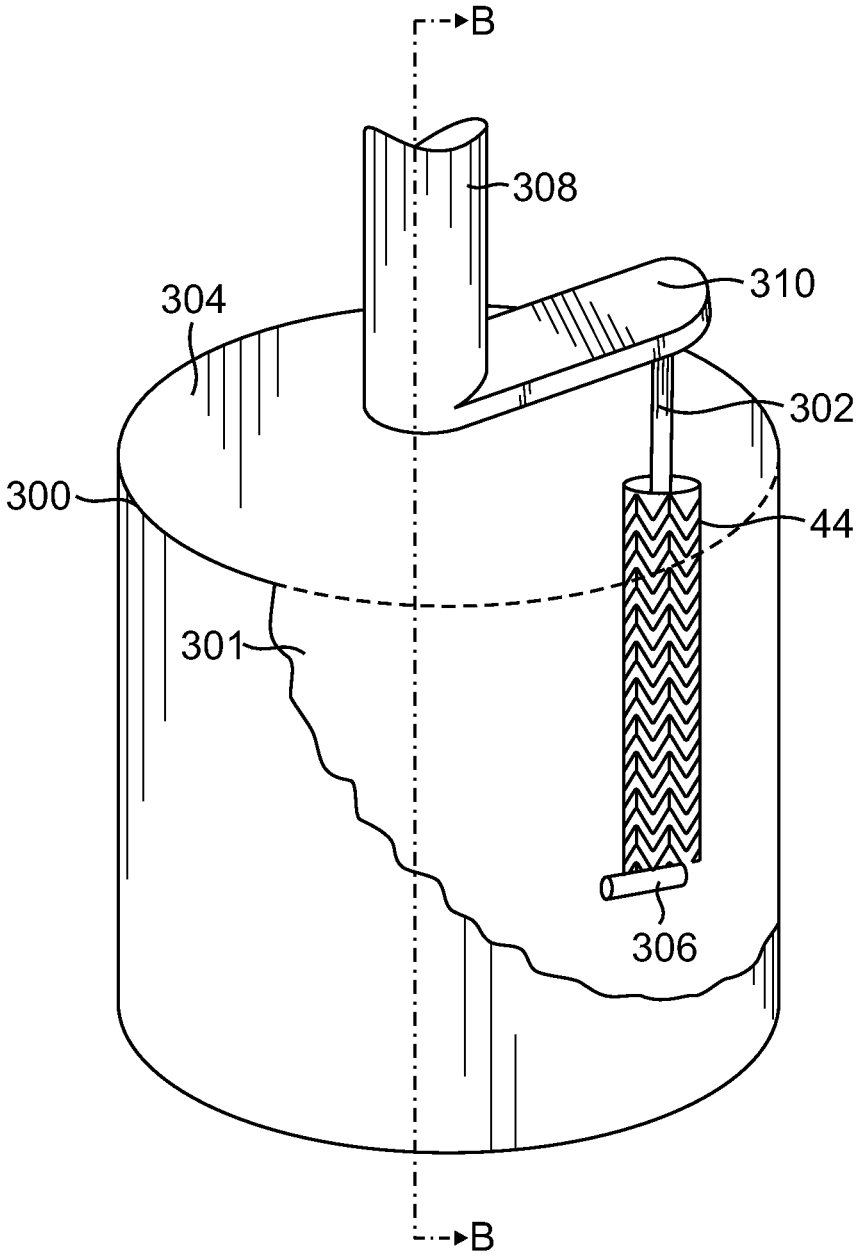
FIG. 4*a* is a perspective schematic view of a fourth embodiment showing features of the present invention of a system for electropolishing a stent in electrolyte solution.

In one aspect of the embodiment exemplified in FIG. 4*a*, the support wire 302 itself may be configured as an anode. Yet, in a variation of this embodiment, exemplified in FIG. 4*b*, the supporting wire does not act as an anode. In this aspect, the invention includes a tube 300' with an inner surface 304', a supporting wire 302', and a rotating arm 310' for rotating a stent 44 about the inner surface of the tube—as in the previous embodiment. However, in this variation, the supporting wire 302' does not act as an anode. Rather, the cylindrical tube 300' is configured to include a plurality of separate conductive electrode panels 350 that extend linearly along the inner surface of the tube 300, parallel with one another and parallel with the vertical axis B'-B' of the tube. The stent 44 mounted on the supporting wire 302', as it is rolled along the inner surface 304' of the tube, passes sequentially over the electrode panels 350 and is in contact with only one panel at a time as it passes. A switching system 312 operated by micro-processor is configured to distribute the electric charge of the panels so that the panel in contact with the passing stent is always positive, or anodic, while the remaining panels are cathodic.

Figure 4B:
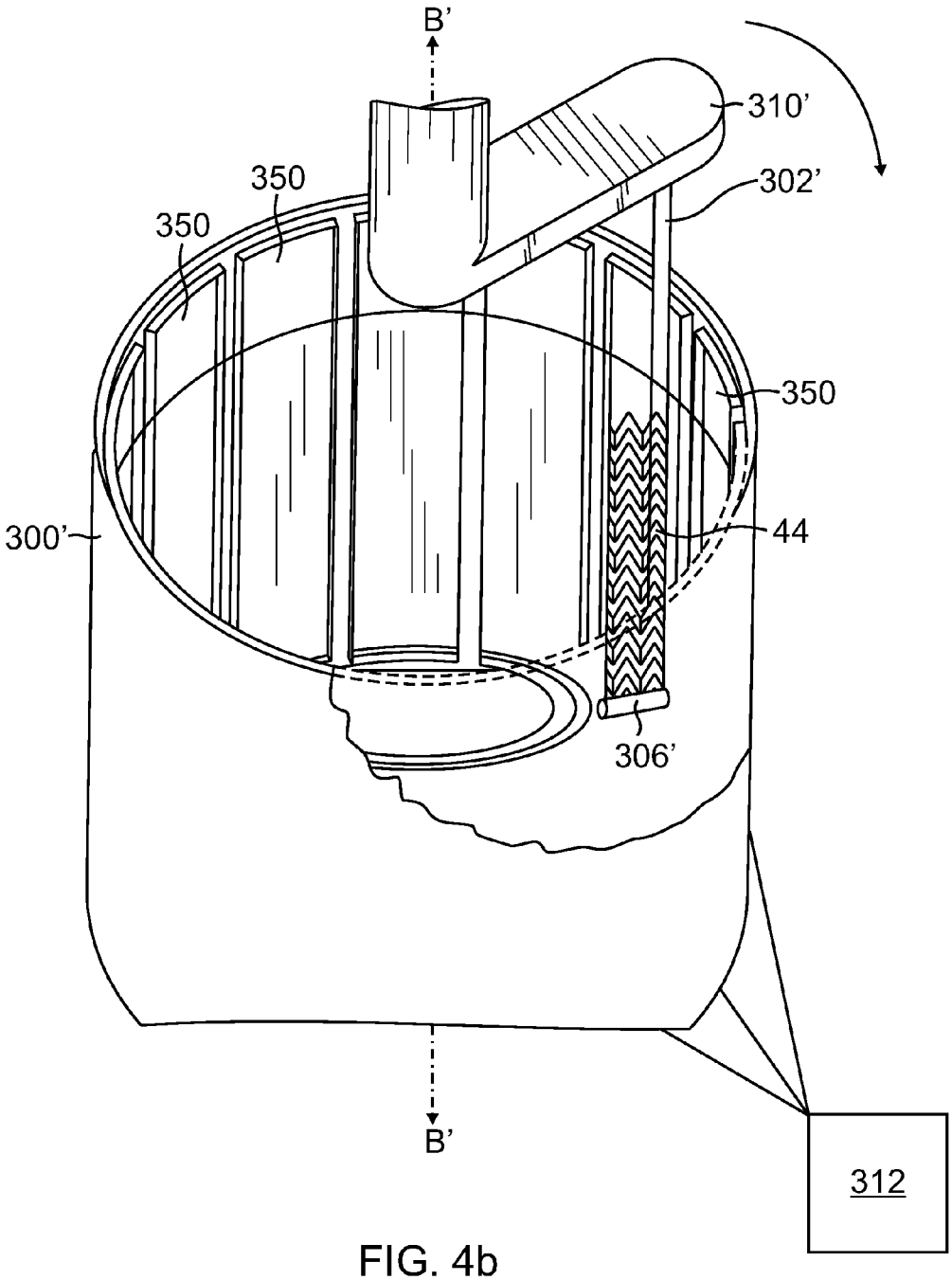
FIG. 4*b* is a perspective schematic view of a variation of the fourth embodiment of FIG. 4*a*.

Thus, in use, there is a continuously changing set of points of contact between the stent and the panel that is acting as anode as the stent passes over the electrode panels, giving rise to the advantageous results described in the previous embodiments. An additional advantage of this embodiment of the invention is that it does not rely on the supporting wire 302' to act as the anode, as is shown in FIG. 4*a*. Rather, the active anode is always outside the bore of the tubular stent, and is effectively a much larger conductive panel element 350 as shown in FIG. 4*b*, capable of distributing current into the stent 44 more effectively with beneficial polishing results.

Figure 5A:
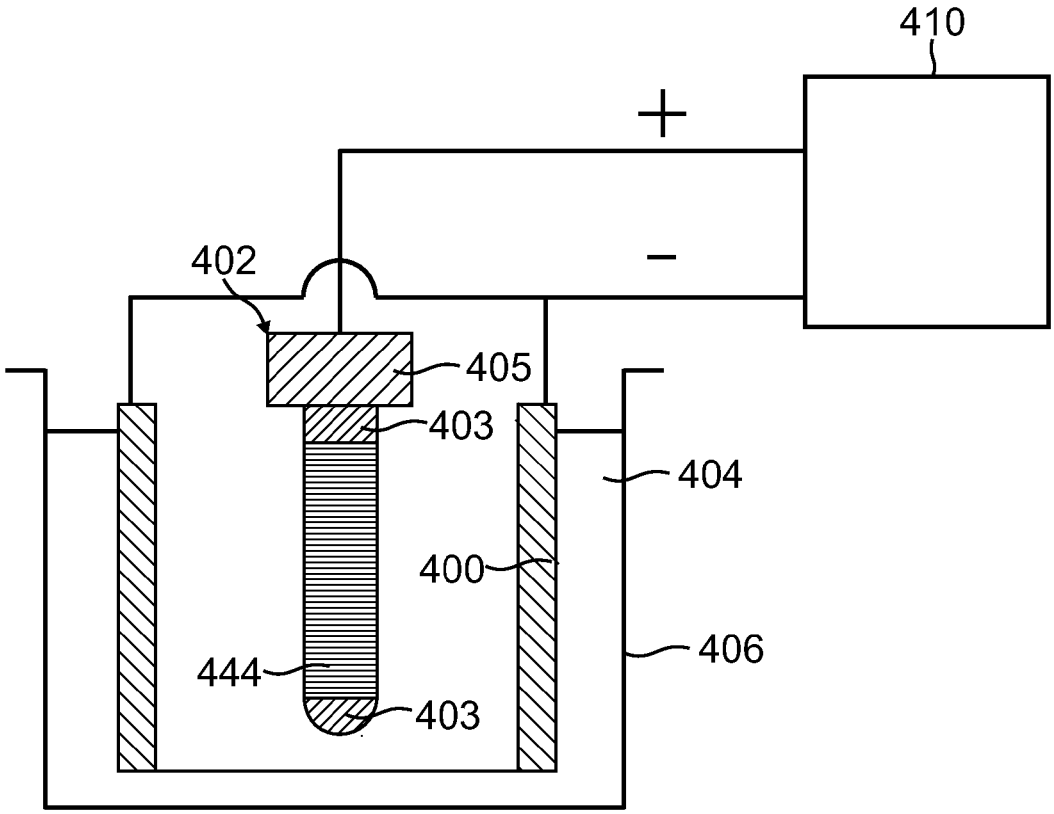
FIG. 5a (Prior Art)
FIG. 5*a* is sectional view of a system known in the prior art for electropolishing stents.

Turning now to the problem that is noted above with reference to FIG. 5*a*, which figure discloses a known method of electropolishing in an electrolyte solution: FIG. 5*a* shows how a cathode 400 in the form of a cylindrical tube may be used to surround a stent 444 having anodic charge during an electrolytic polishing process. Typically, the cathode of this kind is made of a wire mesh, in particular platinum-iridium alloy. The stent is supported by a holder element 402 which is anodically charged, and positioned to hold the stent 444 in an electrolyte solution 404 in a container 406. The holder element 402 may comprise a blade portion 403 for supporting the stent, and a connector portion 405 for connection to a current source. A current source 410 is provided to charge the anode and cathode. As noted above, the stent 444 may require to be manually removed from the electrolyte and rotated end over end between polishing sessions before being repositioned on the blade 403 in order to give it a more evenly polished surface from one end to the other. This requirement for manually reorienting the stent 444 presents a problem in that it is time consuming, it exposes the user to corrosive electrolyte, and it may result in stent damage by accidental manual action.

Figure 5B:
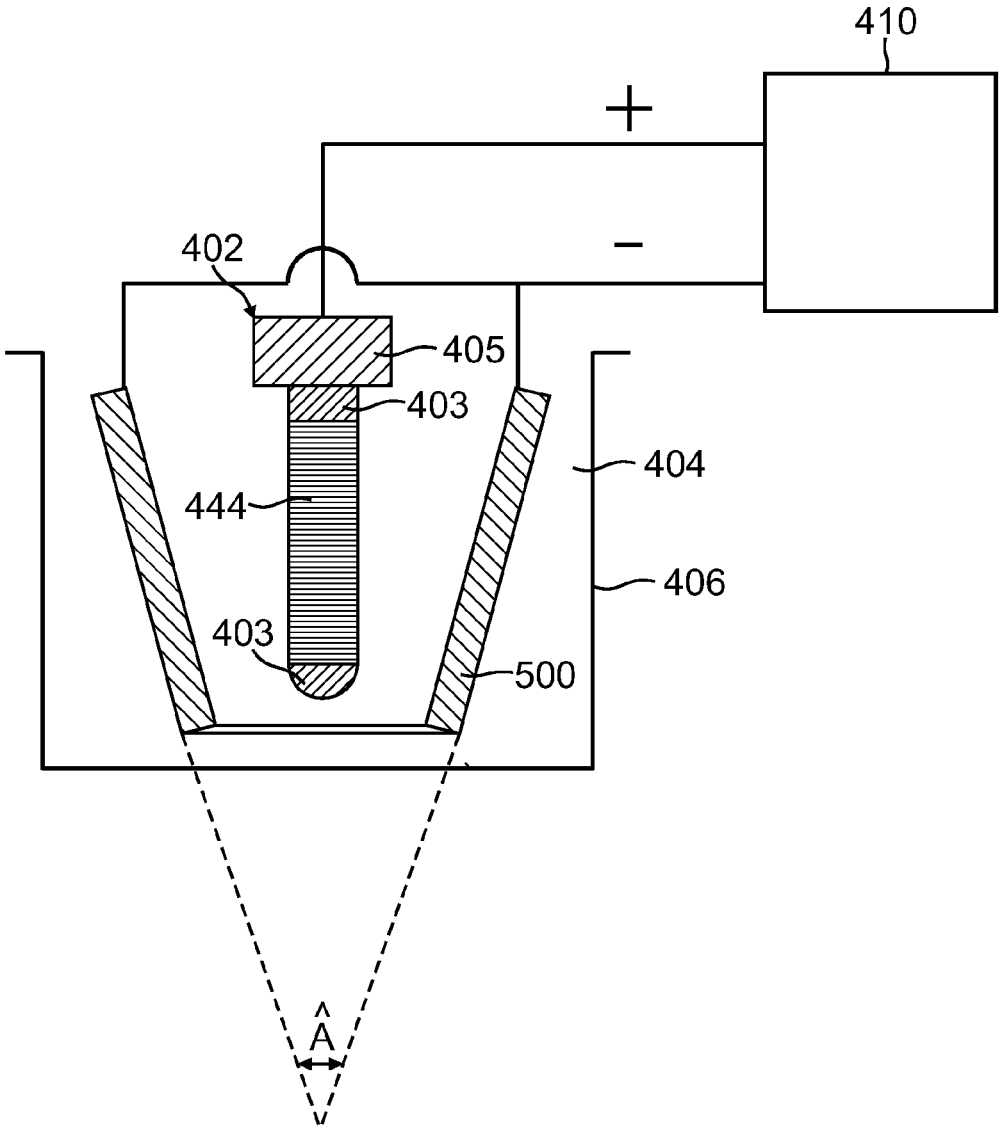
FIG. 5*b* is a sectional view of a fifth embodiment showing features of the present invention of a system for electropolishing a stent in electrolyte solution.

A solution to this problem is disclosed here with reference to FIG. 5*b*. It has been determined that, by using a cathodic mesh 500 that has a frusto conical shape instead of the known cylindrical shaped cathodic mesh 400 shown in FIG. 5*a*, a beneficial result may be obtained in that a more evenly polished surface may be achieved. As shown in FIG. 5*b*, the cathodic mesh 500 tapers inward toward the lower end. Thus, the radius of the cathode 500 is broader at the top end than at the bottom end. As a result, as can be seen with reference to FIG. 5*b*, the distance between the cathode 500 and the stent 444 is greater in the region where the stent is closest to the point of connection 405 to the power supply 410. Preferably, the frusto cone subtends a hypothetical angle A at its apex of between 20 degrees and 30 degrees, as seen in FIG. 5*b*, most preferably between 23 and 27 degrees. It has been determined that, by providing a conically shaped cathode 500 as described, a polished stent 444 may be produced with less final strut width variation than when a cylindrical type cathode is used as in FIG. 5*a*. This advantageous comparative result appears to arise even when comparison is made with a stent that is polished in conjunction with a cylindrically shaped mesh cathode and is also periodically rotated end to end. This approach represents a most advantageous saving in both labor and time.

Figure 6:
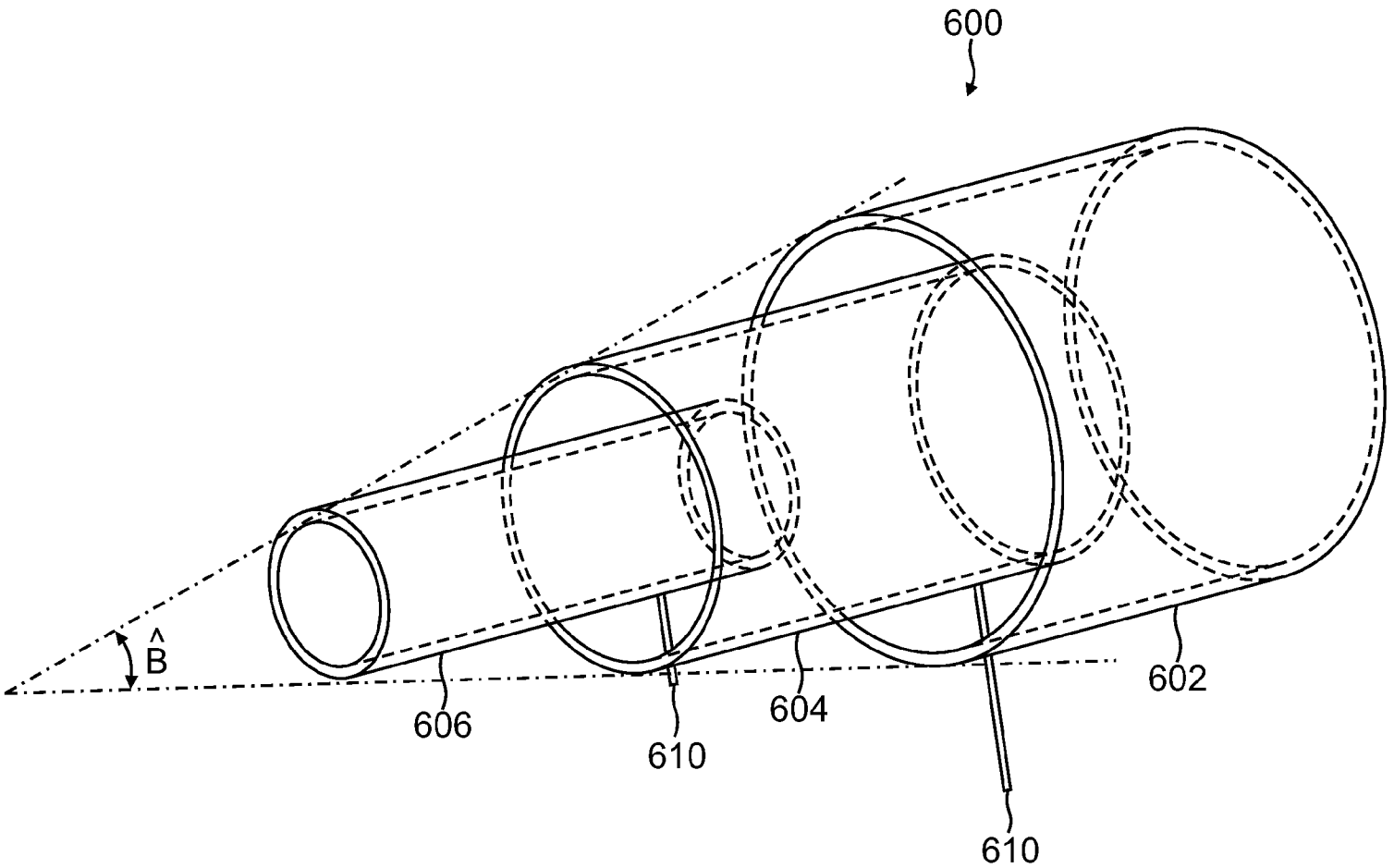
FIG. 6 is a perspective view of a variation of one of the features the embodiment of FIG. 5*b*.

In another aspect of the invention, a variation of the above-described conically shaped cathodic mesh 500 may be employed for electropolishing a metallic stent. With reference to FIG. 6, there is shown a cathodic structural arrangement 600 in which a plurality of cylindrical shaped mesh cathodes 602, 604, 606, are provided. While three cylinders are shown in the figure, fewer or more are possible. Each cathode 602, 604, 606 may have a similar length, but their diameters differ. The cylinders 602, 604, 606 are stacked concentrically. However, they are stacked out of phase with each other so that in combination they provide a stepped conical shaped profile that subtends an angle B as seen in FIG. 6. Each cylinder is prevented from telescopic movement in relation to a neighboring cylinder by pins 610 that are inserted to extend from a larger cylinder into a directly smaller cylinder that fits inside the larger cylinder. Preferably the pins are platinum, or other highly conductive material, so that negative charge applied to one cylinder will spread to all cylinders. Preferably, the cylinders are each made of the same platinum-iridium mesh that is used to produce the conically shaped cylindrical cathode 500 of the previous embodiment.

In use, the resulting stacked cylindrical configuration 600 is utilized as a cathode for electropolishing stents in an electrolyte solution. Because it effectively has a stepped conical shape, it may replace the frusto conical shaped cathode 500 that is shown in FIG. 5*b*. A stent mounted on an anodic blade support, as in FIG. 5*b*, may be inserted down the centerline of the configuration 600. As will be appreciated, the resulting spatial relationship between the anodic stent 444 and the stepped conical cathode 600 is similar to that of stent 444 and frusto conical cathode 500, except that the former provides a stepped conical relationship while the latter provides a continuous conical relationship. Thus, as in the previous embodiment, the present cathode configuration 600 tends to concentrate the current density at the bottom of the mounted stent, where the current density would otherwise be weakest. Thus, the distribution of current density over the length of the stent 444 is evened out, and the stent may receive a more uniform electropolish when submerged in electrolyte solution compared with the cylindrical cathode 400 of the prior art.

Figure 7:
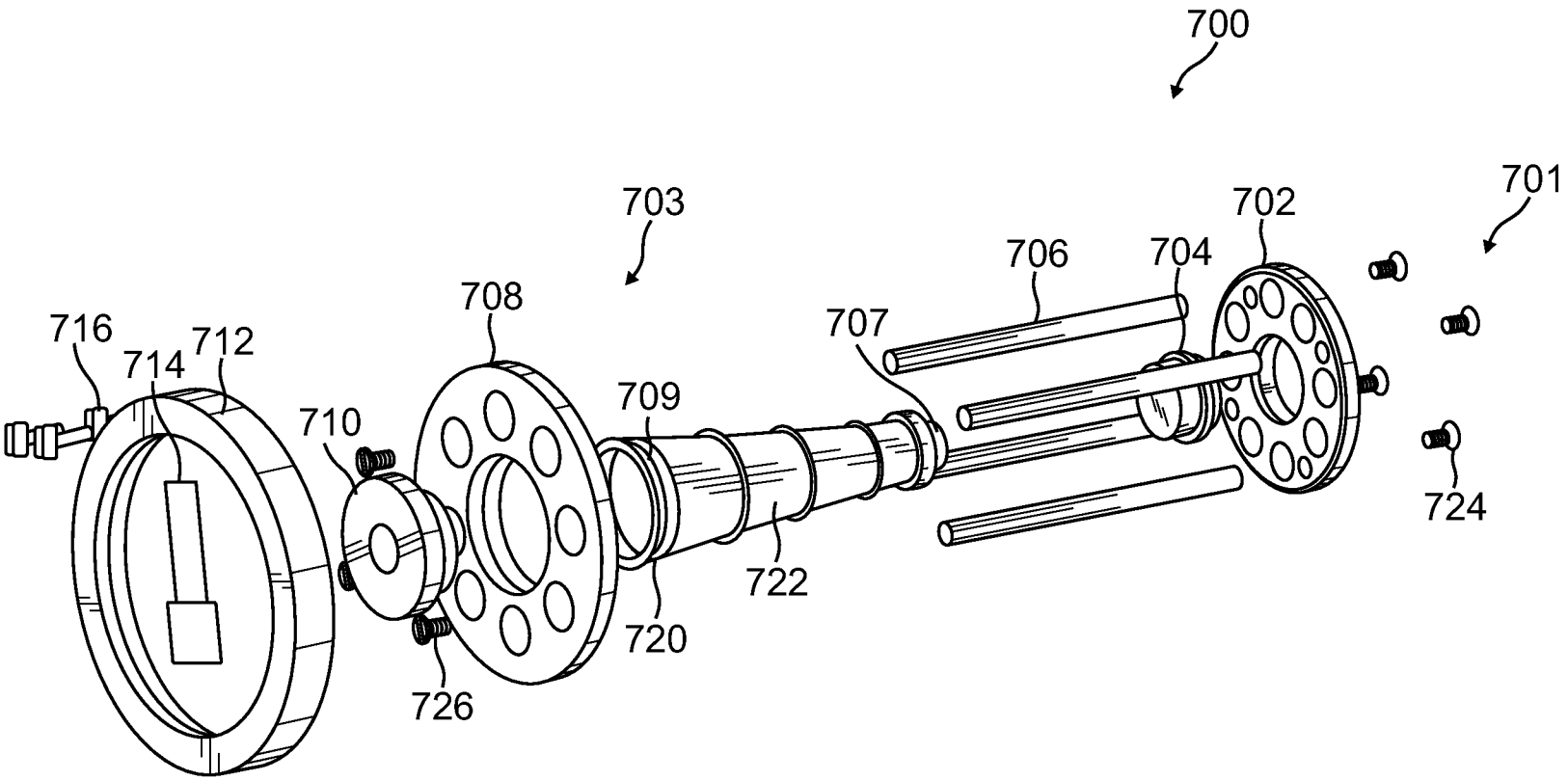
FIG. 7 is an exploded perspective view of a preferred embodiment of the invention shown in FIG. 5*b*.
Figure 8:
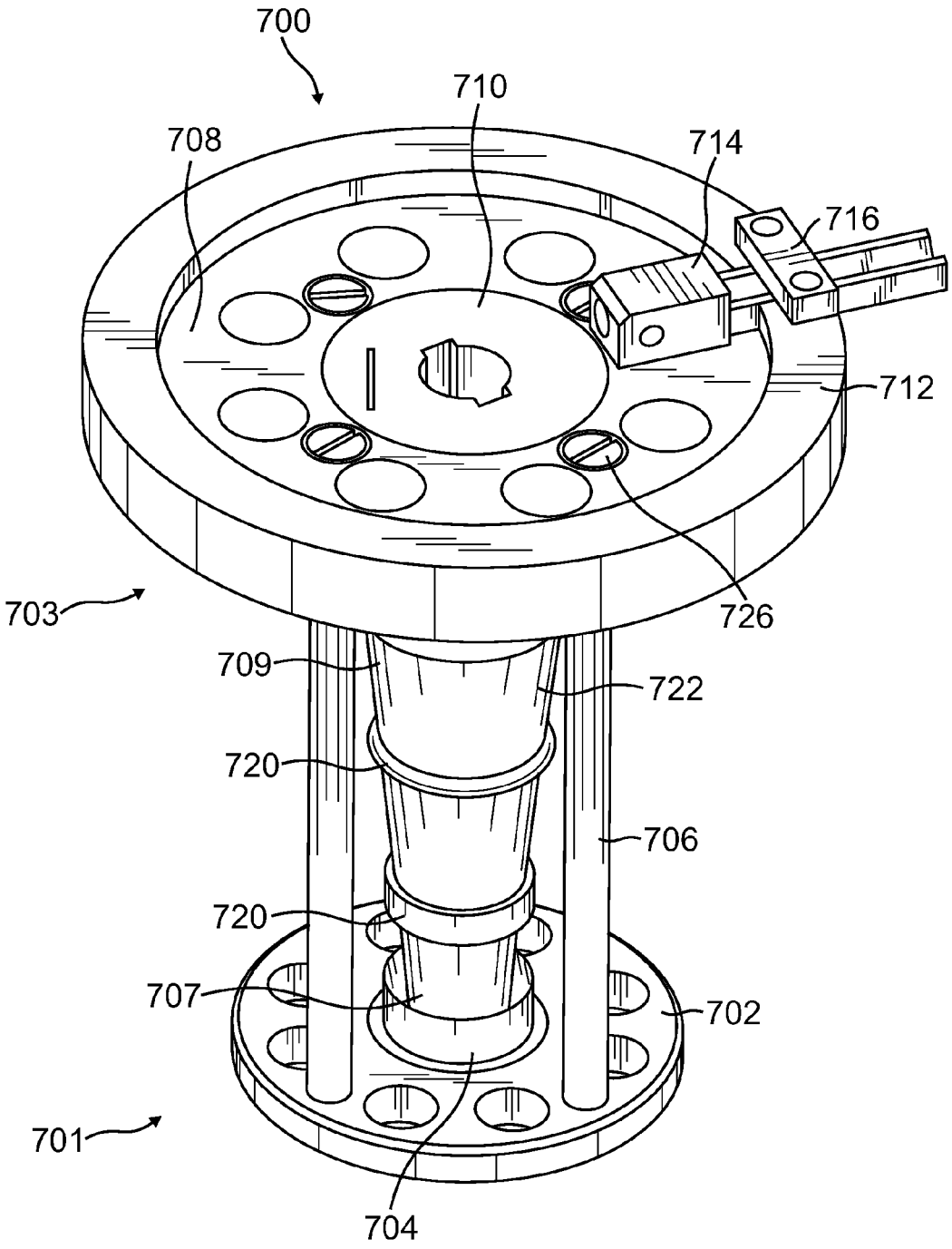
FIG. 8 is a perspective view of the embodiment shown in FIG. 7, in assembled form.

A detailed description of a preferred embodiment of structure 700 suitable for the system and method described above with reference to FIG. 5*b* is described here with reference to FIGS. 7 and 8 which show an exploded view (FIG. 7) and an assembled perspective view (FIG. 8) of such structure 700. These views do not show the stent to be polished or the blade upon which the stent is to be mounted for polishing that are shown in FIG. 5*b*.

The elements shown in FIGS. 7 and 8 are described below. The conical mesh 722 in these figures is the equivalent of the conical mesh 500 described with reference to FIG. 5*b*, and the conical mesh 722 may also be substituted by the stacked cylindrical configuration 600 shown in FIG. 6. The conical mesh 722 is sandwiched between a base plate 702 at the bottom end (that operates to hold elements of the structure 700 together at the base end 701), and by a top plate 708 at the upper end 703. Both the base plate 702 and the top plate 708 preferably have annular shapes as seen in FIG. 7, and are configured to hold the mesh 722 by friction means as follows. A blade guide 704 fits into the annular hole of the base plate 702, and holds the smaller diameter bottom end 707 of the conical mesh 722 by interference. Key hole element 710 fits into the annular hole of the top plate 708 and holds the larger diameter upper end 709 of the conical mesh 722 by interference. Four rod-like standoff elements 706 set the height between top plate 708 and bottom plate 702, and hence the top and bottom of the mesh 722. These standoff elements 706 are adjustable for different lengths of mesh as may be required for different lengths of stent. The standoff elements 706 may be connected to the top plate and bottom plate by screws 726 and 724 respectively. Ring holders 720 are annular rings of different diameter that hold the frustoconical shape of the mesh 722 in a fixed configuration. The stent to be polished (not shown in FIGS. 7 and 8) will be installed over a blade (not shown in FIGS. 7 and 8, but shown as element 403 in FIG. 5*b*) and the blade and stent will be inserted into the frustoconical mesh 722 before the various elements are fitted together as shown in FIG. 8.

Elements 712, 714, and 716 are directed to holding the entire structural device 700 in position on a polishing beaker, and to keeping the power cycle from being started until the blade is securely located in the assembly fixture. Sensor ring 712 holds the assembly in place, and adapts to the outside diameter of the polishing beaker (not shown).

In use, this structure 700 may be assembled with a stent to be polished inserted inside mesh 722. The structure is then inserted in an electrolyte bath. Positive charge is then applied to the stent via the blade, and a negative charge is applied to mesh. Electropolishing then takes place as described above.

Figure 9:
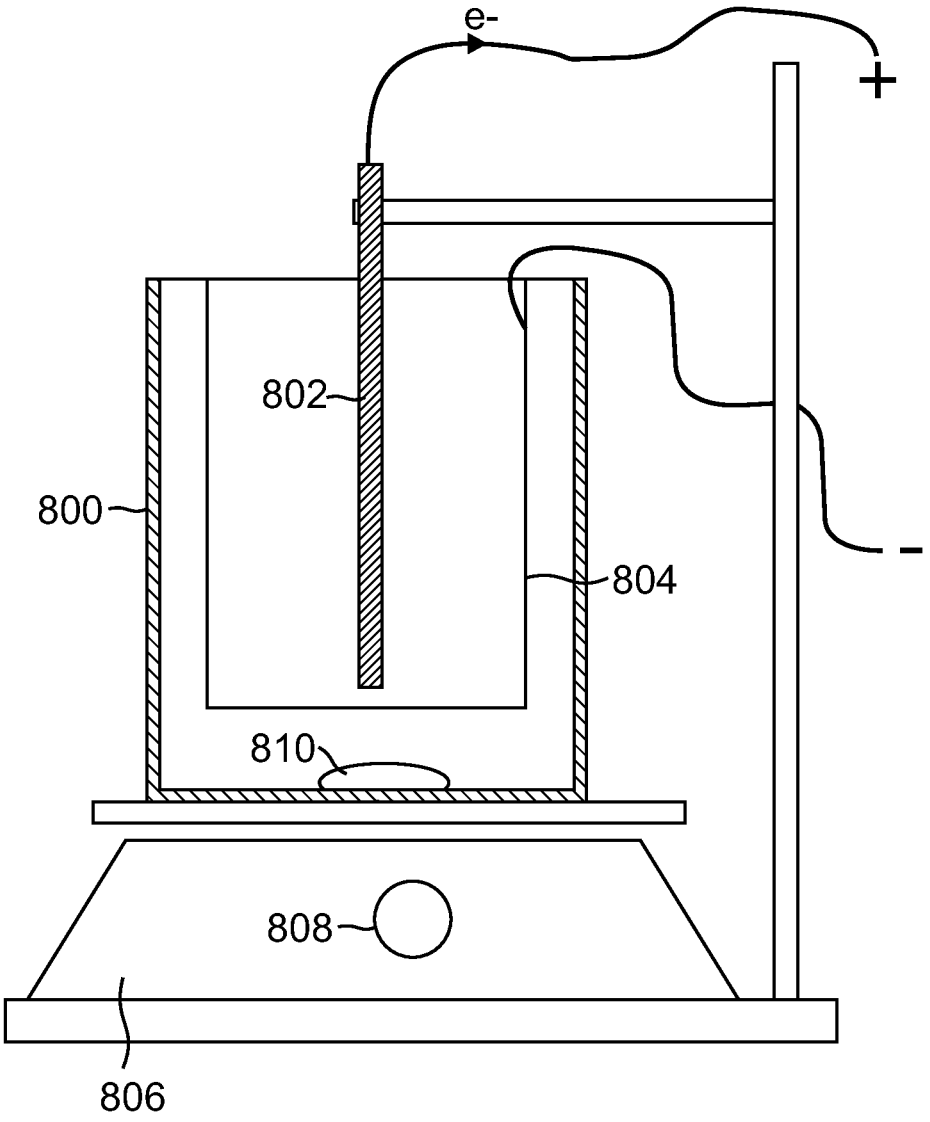
FIG. 9 is a schematic view of a further aspect of the present invention.

In a final aspect of the invention, appropriate agitation of the electrolyte solution may be achieved in the following manner, and is applicable to all embodiments disclosed herein. As shown in FIG. 9, an electrolyte bath 800 containing the polishing system 802 that is being used, is placed on top of known magnetic stirrer 806 device. A cathode 804 is inserted in the electrolyte to surround the polishing system 802. A rotatable magnet is positioned in the stirrer 806 according to known principles, and a loose magnet or piece of metal 810 is positioned within the electrolyte. A process of electropolishing may then be caused to take place in the following manner: the electropolishing system is run for a certain period of time, whereupon it is interrupted and the magnetic stirrer 806 is run for a certain period of time which is sufficient to remove the anodic layer that builds up during the process of electropolishing. The times of running electropolishing and magnetic stirring will depend on various factors including the concentration of electrolyte, the current density, the electrolyte temperature. However, the basic principle of interruption and stirring, during the overall process, is found have beneficial effect on the final distribution of polishing on the prosthesis.

Thus, it is seen that the system and structure of the present invention provides novel and useful features for electropolishing tubular metal prostheses. The present invention may, of course, be carried out in other specific ways than those herein set forth without departing from the essential characteristics of the invention. The present embodiment are, therefore, to be considered in all respects as illustrative and not restrictive, and all changes coming within the meaning and equivalency range of the appended claims are intended to be embraced therein.

We claim:

1. A system for electropolishing a tubular metal prosthesis positioned in an electrolyte bath, the system comprising:

a first and a second cylinder positioned parallel to each other and spaced apart sufficiently to support the prosthesis when the prosthesis extends parallel to the first and second cylinders;

a wire element configured to extend through the tubular prosthesis and to bias towards the two cylinders, whereby the wire element is capable of contacting an inner wall of the tubular prosthesis to urge the prosthesis into contact with the first and second cylinders;

wherein, frictional engagement between the cylinders and the prosthesis causes the prosthesis and the cylinders to rotate in unison if any one of the prosthesis and cylinders rotates, whereby, when the prosthesis rotates, the wire element remains in biased contact with the inner wall through a continuously changing set of points of contact;

wherein the wire element is capable of conducting a charge and passing the charge into the prosthesis through the continuously changing set of points of contact; and a motor configured to rotate a first magnet located outside the electrolyte bath, and wherein the first cylinder includes a second magnetic flywheel rotationally mounted on the first cylinder, whereby rotation of the first magnet outside the bath causes rotation of the second magnetic flywheel inside the bath, thereby causing the first cylinder to rotate.

2. The system of claim 1, wherein the wire element is configured to rotate, and thereby, through frictional engagement with the prosthesis, to cause the prosthesis to rotate.

* * * * *